US010370890B2

(12) United States Patent
Fujishin et al.

(10) Patent No.: US 10,370,890 B2
(45) Date of Patent: Aug. 6, 2019

(54) DOOR FRAME STRUCTURE AND METHOD FOR MOUNTING DOOR FRAME STRUCTURE

(71) Applicant: NISSHO INDUSTRIAL CO., LTD., Fukuoka (JP)

(72) Inventors: Narinobu Fujishin, Fukuoka (JP); Ryo Imuta, Fukuoka (JP); Shota Inoue, Fukuoka (JP)

(73) Assignee: NISSHO INDUSTRIAL CO., LTD., Fukuoka (JP)

( * ) Notice: Subject to any disclaimer, the term of this patent is extended or adjusted under 35 U.S.C. 154(b) by 0 days.

(21) Appl. No.: 15/554,167

(22) PCT Filed: Dec. 9, 2015

(86) PCT No.: PCT/JP2015/084569
§ 371 (c)(1),
(2) Date: Aug. 28, 2017

(87) PCT Pub. No.: WO2016/139864
PCT Pub. Date: Sep. 9, 2016

(65) Prior Publication Data

US 2018/0080272 A1 Mar. 22, 2018

(30) Foreign Application Priority Data

Mar. 3, 2015 (JP) ..... 2015-056897

(51) Int. Cl.
*E06B 1/04* (2006.01)
*E06B 1/12* (2006.01)
(Continued)

(52) U.S. Cl.
CPC ..... *E06B 1/6007* (2013.01); *E06B 1/16* (2013.01); *E06B 1/18* (2013.01); *E06B 1/6084* (2013.01); *E06B 5/00* (2013.01); *E06B 3/5892* (2013.01)

(58) Field of Classification Search
CPC . E06B 1/56; E06B 1/6007; E06B 1/16; E06B 1/18; E06B 1/6084; E06B 1/52;
(Continued)

(56) References Cited

U.S. PATENT DOCUMENTS 3,189,137 A * 6/1965 Harris ..... E06B 1/6015 52/213
3,363,365 A * 1/1968 Laepple ..... E06B 3/5892 49/169
(Continued)

FOREIGN PATENT DOCUMENTS

JP 10-018723 A 1/1998
JP 4079217 B2 7/2004
(Continued)

*Primary Examiner* — Kyle J. Walraed-Sullivan
(74) *Attorney, Agent, or Firm* — Heedong Chae; Lucem, PC

(57) ABSTRACT

[Object] To provide a door frame structure and a method for mounting the door frame structure which improve rigidity, prevent deformation that is caused by relative story displacement of a building in the event of an earthquake, and enable easy mounting.

[Solution Means] A door frame structure 1 is indirectly mounted to a wall surface 4 via mounting angles 11 fixed to the first reinforcing members 9. Therefore, the door frame structure 1 does not follow relative story displacement of the wall surface 4 caused by lateral vibration in the event of an earthquake, so that deformation of the door frame structure 1 is minimized, and a door 31 can be opened and closed even in an emergency.

22 Claims, 9 Drawing Sheets

(51) Int. Cl.

| | |
|---|---|
| ***E06B 1/60*** | (2006.01) |
| ***E06B 5/00*** | (2006.01) |
| ***E06B 1/16*** | (2006.01) |
| ***E06B 1/18*** | (2006.01) |
| *E06B 3/58* | (2006.01) |

(58) Field of Classification Search
CPC ..... E06B 1/60; E06B 1/6053; E06B 1/6092; E06B 1/62; E06B 5/10
USPC ..... 52/210, 213, 205, 206, 212
See application file for complete search history.

(56) References Cited

U.S. PATENT DOCUMENTS 3,571,995 A * 3/1971 Kasprzak ..... E06B 1/20 49/505
3,593,473 A * 7/1971 King ..... E06B 1/16 52/211
3,690,082 A * 9/1972 Byland ..... E06B 1/18 52/213
3,861,099 A * 1/1975 Faudree ..... E06B 1/18 52/211
4,034,513 A * 7/1977 Richardson ..... E06B 1/18 49/504
4,179,849 A * 12/1979 Kuffner ..... E06B 1/603 49/505
4,594,831 A * 6/1986 Winyard ..... E06B 1/045 49/DIG. 1
4,813,204 A * 3/1989 Rentschler ..... E06B 1/20 49/505
5,233,802 A * 8/1993 Rogers ..... E06B 1/20 49/505
5,644,881 A * 7/1997 Neilly ..... E06B 3/5892 49/505
5,740,631 A * 4/1998 Mori ..... E06B 1/56 206/325
5,857,299 A * 1/1999 Gyllenberg ..... E06B 1/10 49/504
5,934,030 A * 8/1999 McDonald ..... E06B 1/30 49/505
6,178,717 B1 * 1/2001 Loop ..... E06B 1/6015 49/505
6,286,274 B1 * 9/2001 McKann ..... E06B 1/20 49/505
6,931,810 B2 * 8/2005 Beaudoin ..... E06B 3/54 52/213
8,528,280 B2 * 9/2013 Coil ..... E06B 5/006 52/204.1
8,572,929 B2 * 11/2013 Stumm ..... E06B 1/325 52/204.71
2003/0041539 A1 * 3/2003 Bernacki ..... E06B 3/5892 52/204.54
2003/0046886 A1 * 3/2003 Potts ..... E06B 1/20 52/212
2003/0066256 A1 * 4/2003 DeBlock ..... B32B 17/10 52/208
2003/0188498 A1 * 10/2003 Lewkowitz ..... E06B 3/5892 52/208
2004/0000109 A1 * 1/2004 Bourassa ..... E06B 3/54 52/204.54
2004/0068942 A1 * 4/2004 Krochmal ..... E06B 3/5892 52/204.71
2004/0083678 A1 * 5/2004 Tumlin ..... E06B 3/5892 52/717.01
2006/0272220 A1 * 12/2006 Smith ..... E06B 1/18 49/504
2007/0044401 A1 * 3/2007 Bonshor ..... A47J 17/02 52/213
2008/0122324 A1 * 5/2008 Bienick ..... E05D 7/1011 312/116
2010/0287839 A1 * 11/2010 Barnard ..... E06B 3/5892 49/197
2011/0179730 A1 * 7/2011 Kolovich ..... E06B 1/12 52/204.2
2012/0311944 A1 * 12/2012 Stier ..... E06B 1/6023 52/213
2013/0219813 A1 * 8/2013 Gadoury ..... E06B 1/045 52/211
2015/0047269 A1 * 2/2015 Messenger ..... E06B 7/14 52/58
2015/0275513 A1 * 10/2015 Feldpausch ..... E04B 2/745 52/213
2016/0097226 A1 * 4/2016 Timko ..... E06B 7/18 49/504
2017/0130519 A1 * 5/2017 Miller ..... E06B 3/549
2017/0167185 A1 * 6/2017 Boer ..... E06B 1/18
2017/0218681 A1 * 8/2017 Siddiqui ..... E06B 1/325

FOREIGN PATENT DOCUMENTS

JP 2006-316446 A 11/2006
JP 5475249 B2 11/2009
JP 2010-255331 A 11/2010

* cited by examiner

[Fig. 1]
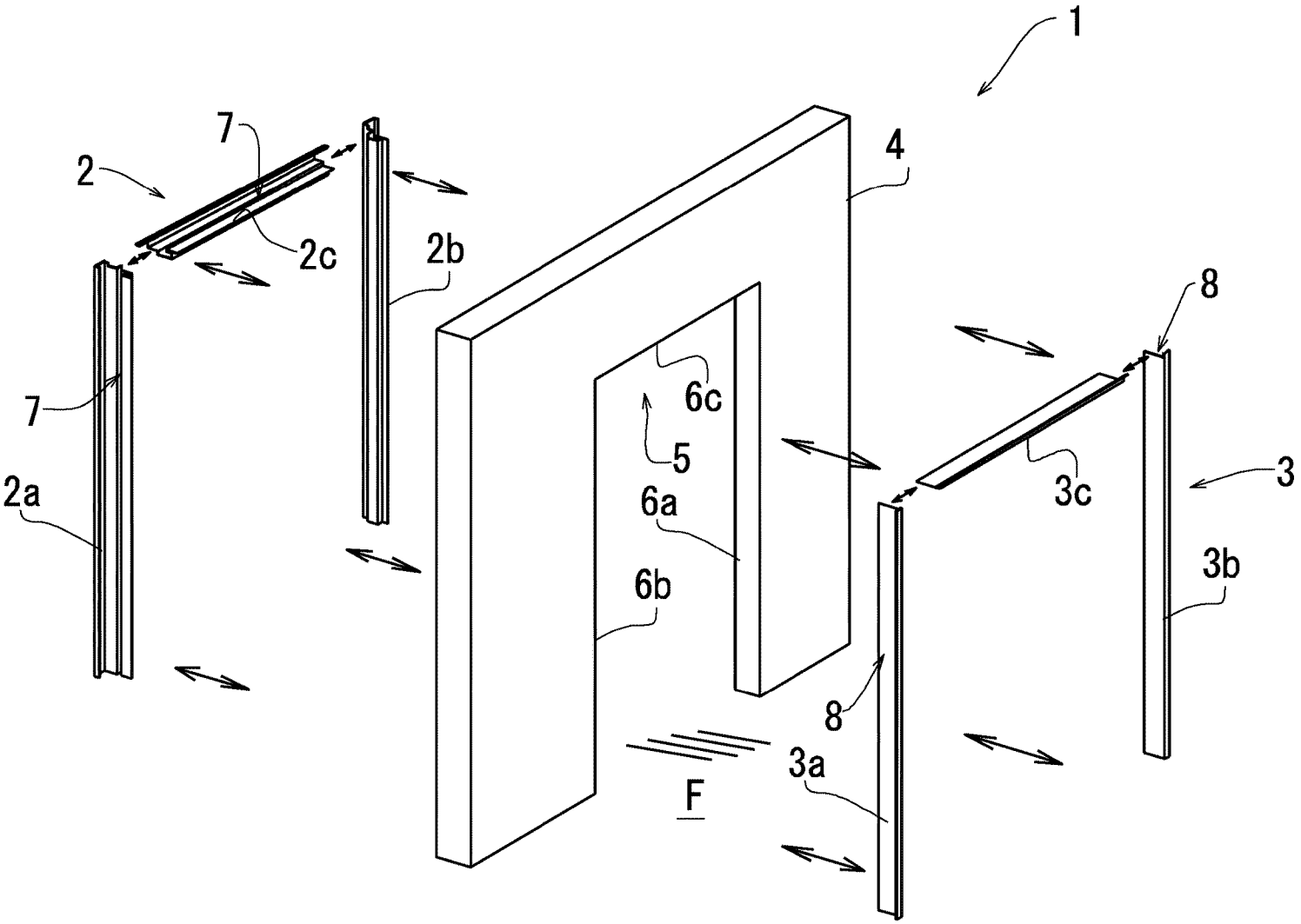

[Fig. 2]
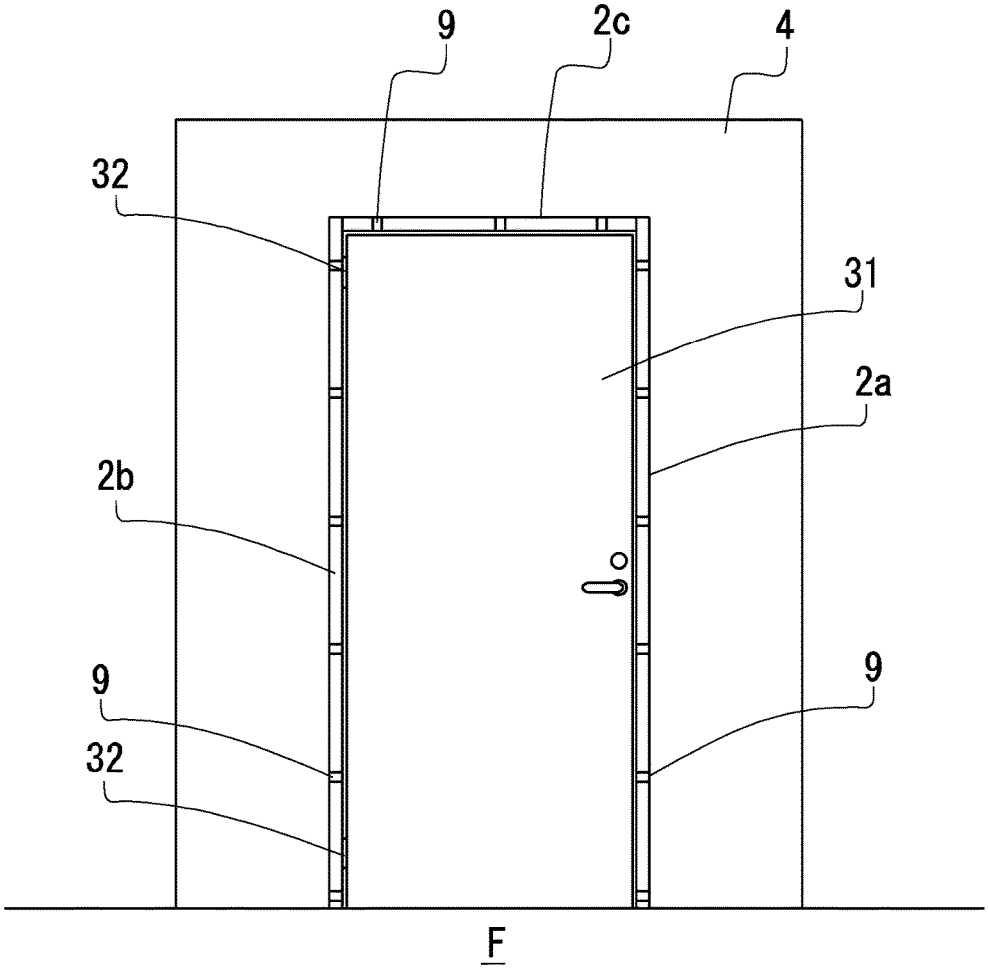

[Fig. 3]
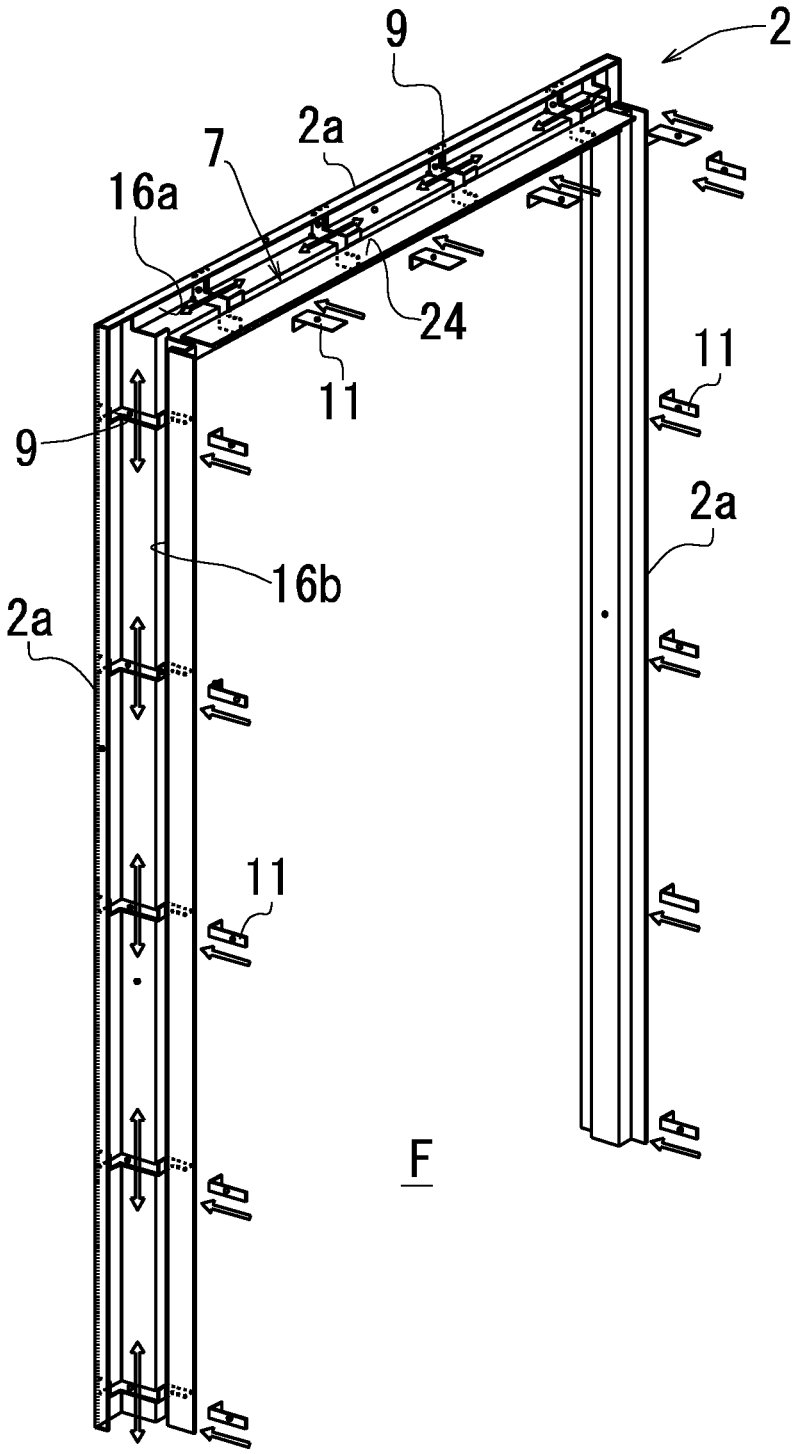

[Fig. 4]
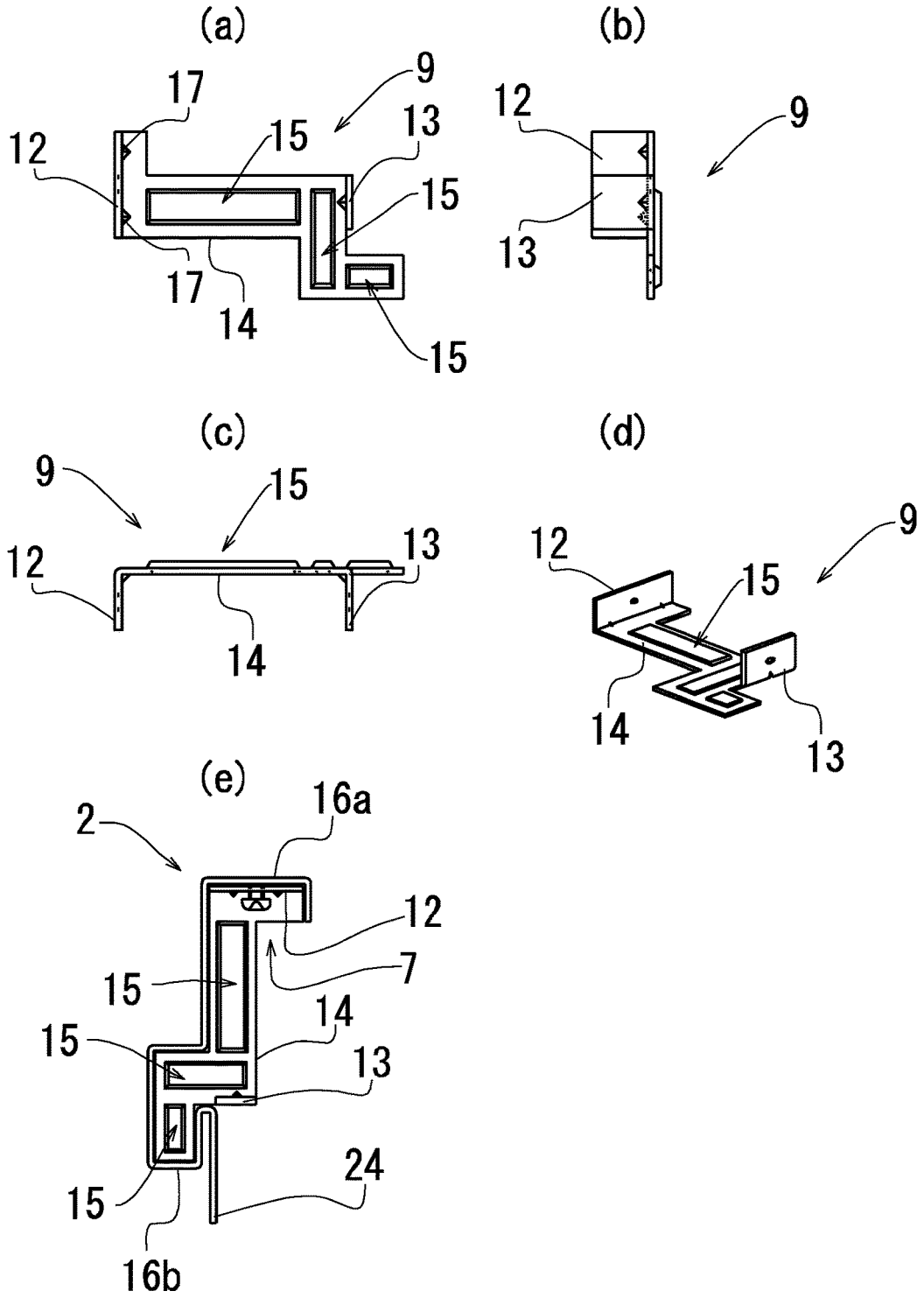

[Fig. 5]
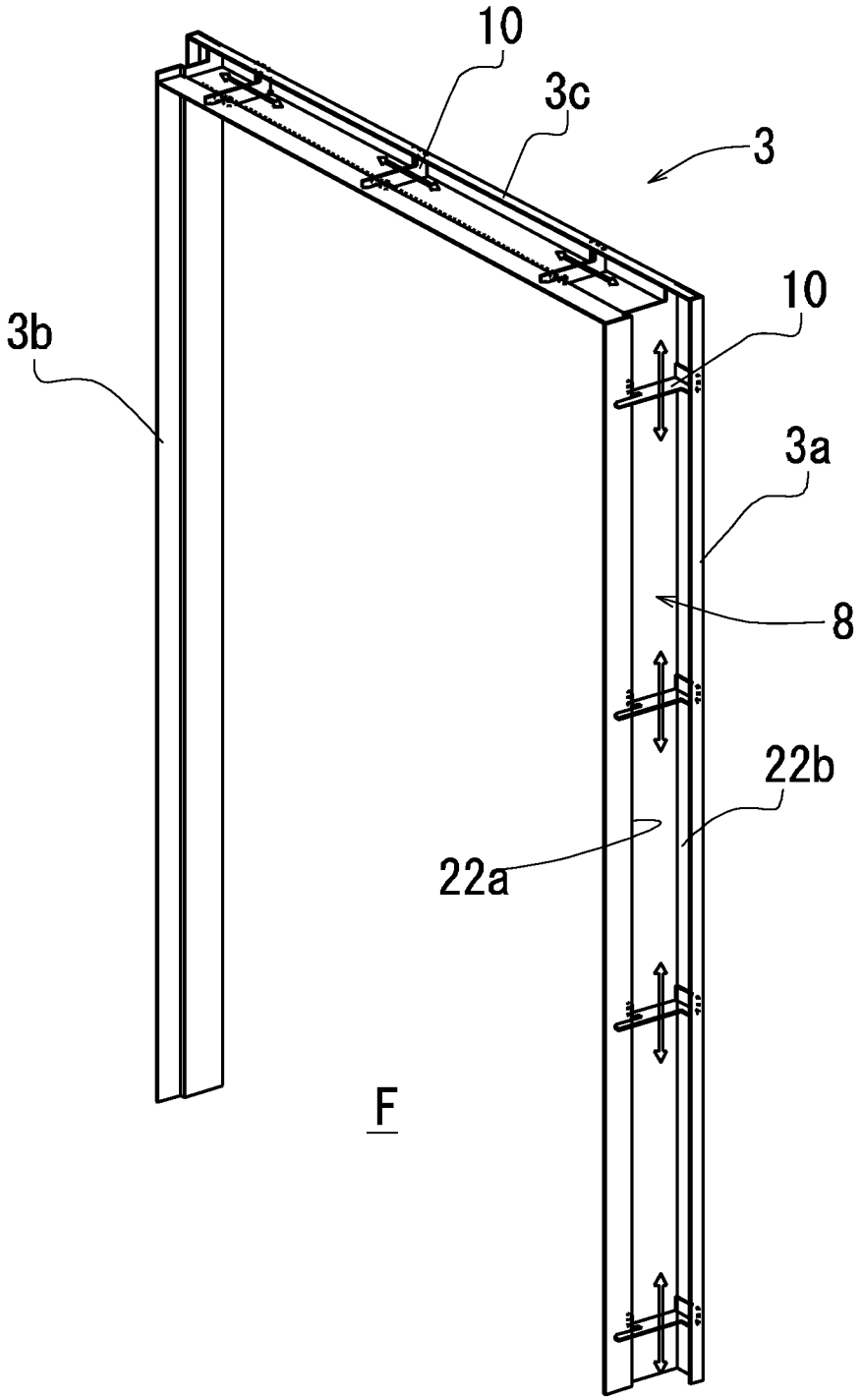

[Fig. 6]
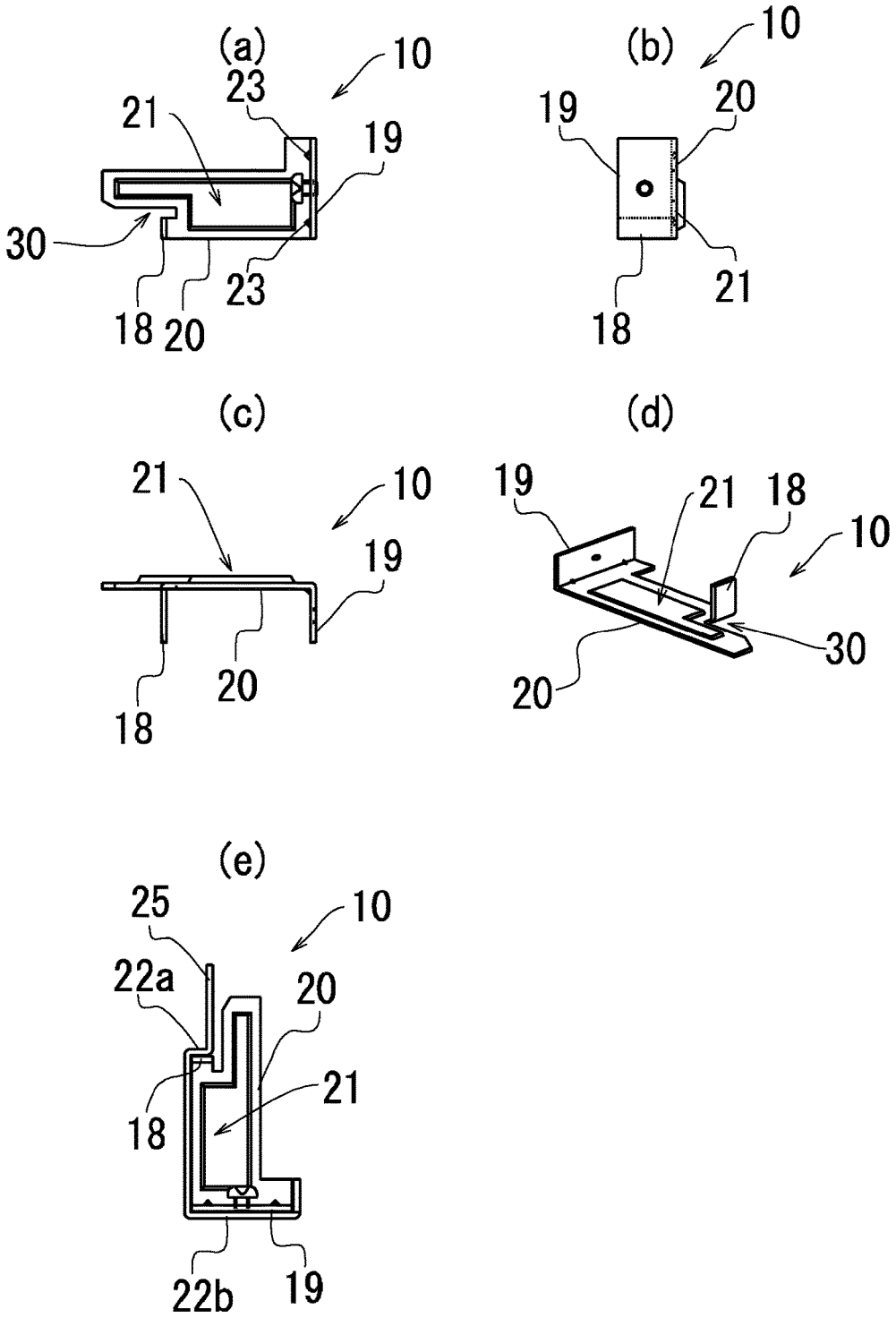

[Fig. 7]
(a)
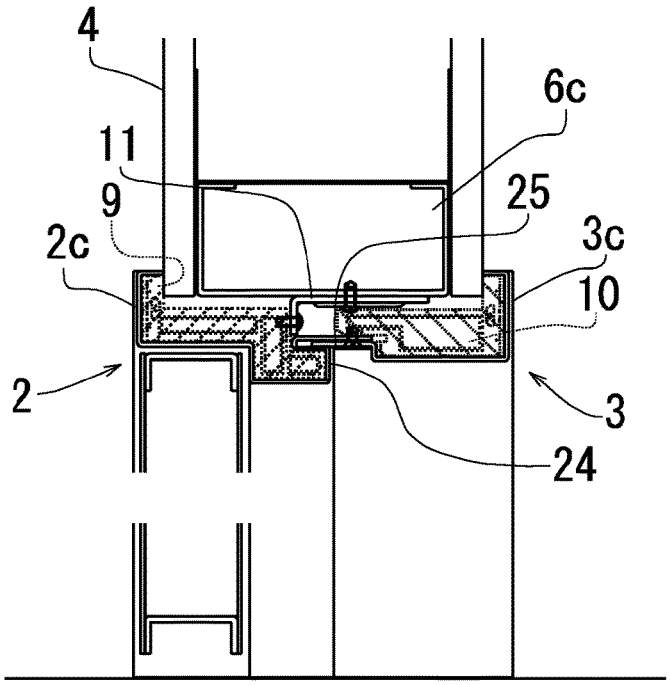
(b)
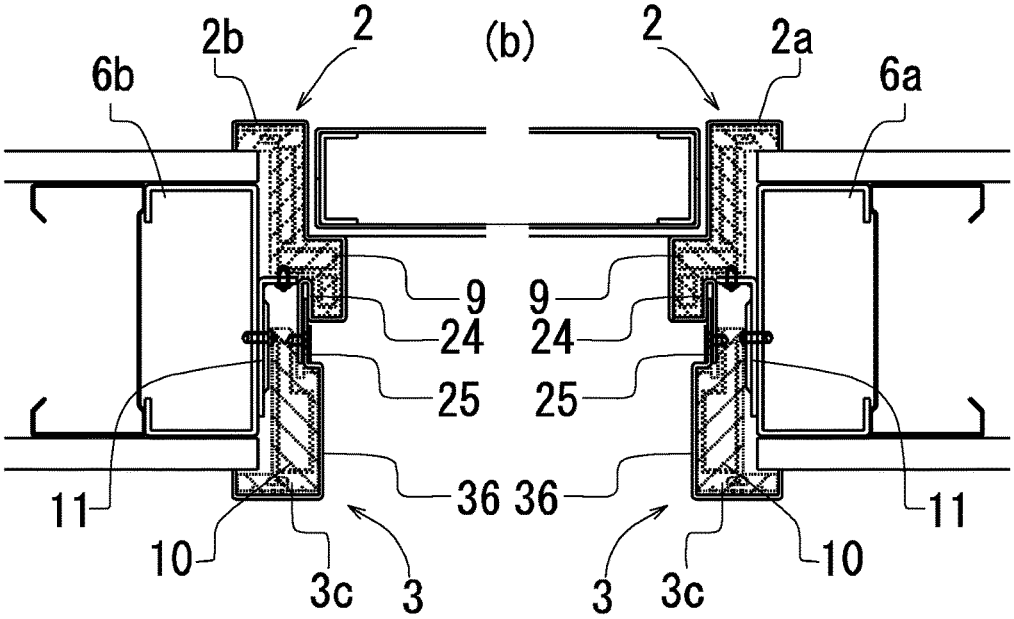

[Fig. 8]
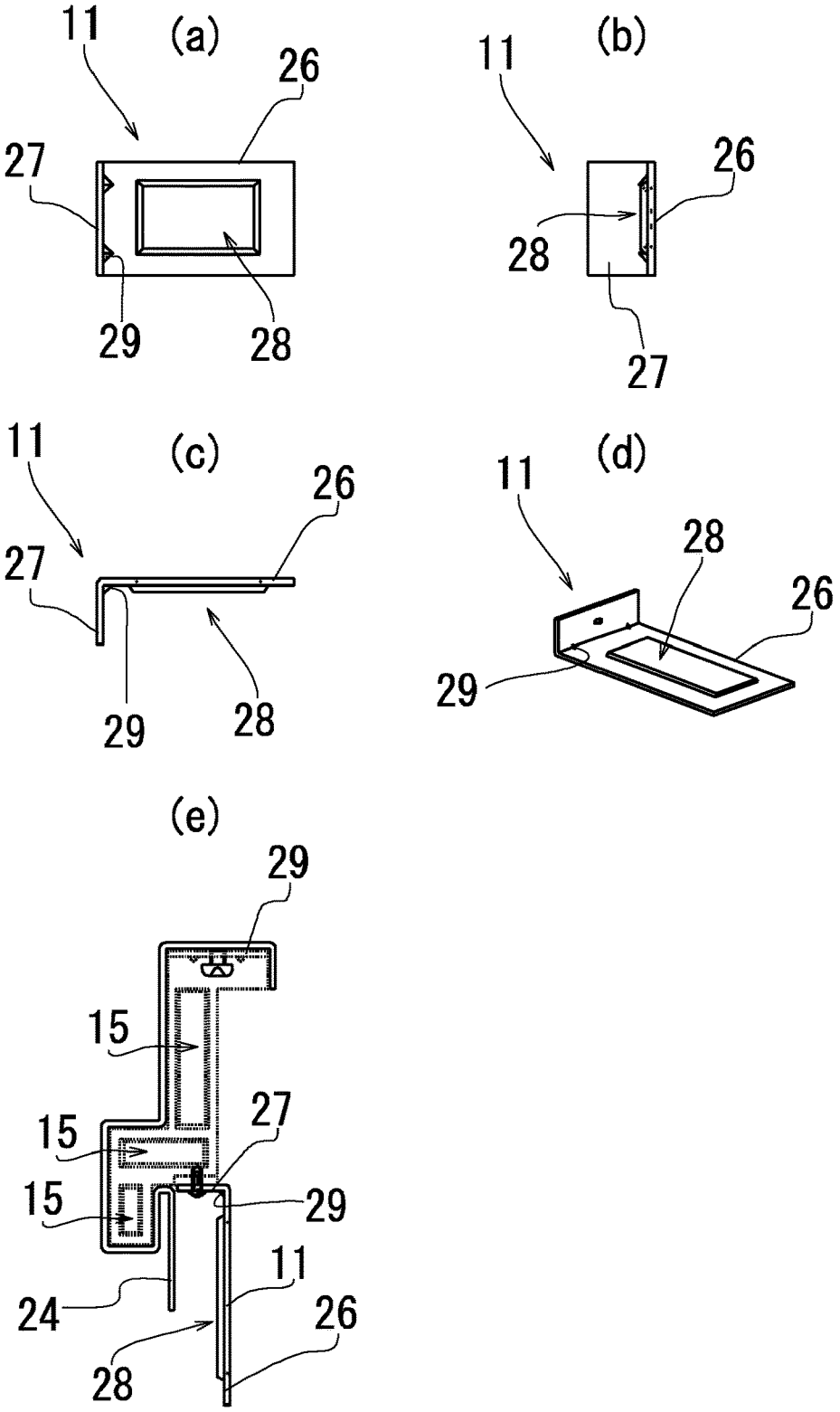

[Fig. 9]
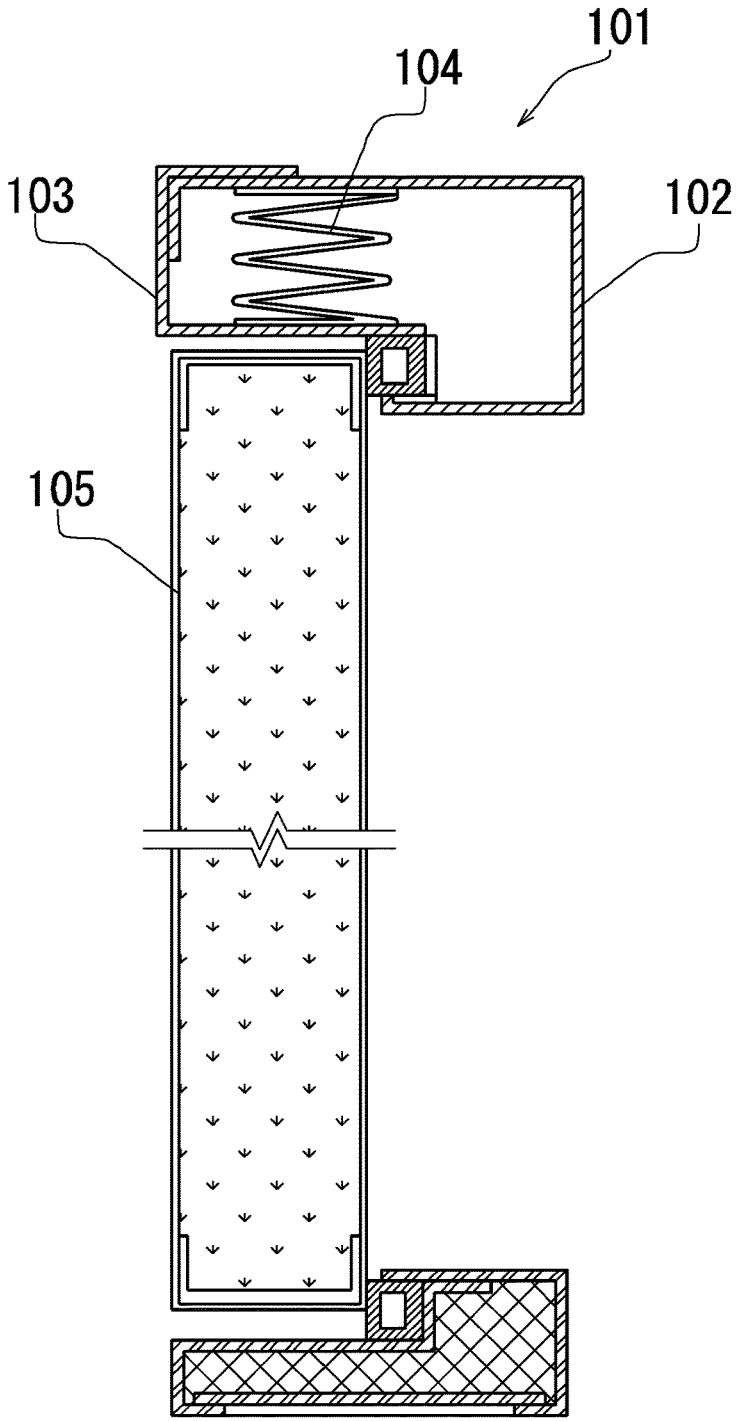
-- PRIOR ART --

DOOR FRAME STRUCTURE AND METHOD FOR MOUNTING DOOR FRAME STRUCTURE

CROSS-REFERENCE TO RELATED APPLICATION

This application claims the benefit of Japanese Application No. 2015-056897 filed Mar. 3, 2015 with the Japanese Patent Office, the disclosure of which is incorporated herein by reference.

TECHNICAL FIELD

The present invention relates to a door frame structure and a method for mounting the door frame structure. Specifically, the present invention relates to a door frame structure with high rigidity that resists deformation in the event of relative story displacement during an earthquake and a method for enabling easy mounting the door frame structure.

BACKGROUND ART

A door of an office building, a tenant building, an apartment building, or the like is generally, for earthquake-proofing purposes, mounted to a wall having a wall opening formed therein to which a door frame structure made of steel with a certain rigidity is mounted, and supported by the door frame structure pivotably about one vertical side of the door.

Such a door frame structure includes a pair of left and right vertical frame members and a cross frame member joining upper portions of the vertical frame members, and is an inverted U-shape as a whole, and each frame member is firmly attached to a bed curing material (post) defining a wall opening by a known fixing means such as welding, adhesion, and caulking, etc.

However, in a case where a door frame structure is firmly mounted to a wall or the like in which a wall opening is formed, when lateral vibration occurs due to an earthquake, etc., relative story displacement of a skeleton such as a wall, etc., may occur, and following this relative story displacement, the door frame structure plastically deforms into a diamond shape, and may result in a situation where the door cannot be opened and closed and trap an inhabitant inside the building.

To address such a problem, Patent Literature 1 discloses a door frame structure that releases a door even when the door frame structure deforms following relative story displacement of a skeleton caused by an earthquake and the door and the door frame structure coming into contact with each other.

In detail, as shown in FIG. 9, a door frame structure 101 includes two frame members 102 and 103 that are folded. The frame members 102 and 103 are movable frame members coupled so as to be mutually movable toward the inside of the door frame structure 101.

In addition, between the frame members 102 and 103, a coil spring 104 elastically deformable in the up-down direction, plastically supports the frame members 102 and 103.

In such a state, for example, when an earthquake occurs and a skeleton (not shown) greatly oscillates, according to relative story displacement of the skeleton, the door frame structure 101 also plastically deforms, and the door frame structure 101 comes into contact with an outer edge of a door 105. Then, due to permanent deformation of the door frame structure 101 after earthquake vibration stops, the door frame structure 101 and the door 105 come into contact with each other.

However, if contact pressure between the door frame structure 101 and the door 105 exceeds a predetermined pressure, the coil spring 104 interposed between the frame members 102 and 103 absorbs the contact pressure between the door frame structure 101 and the door 105. Further, the frame members 102 and 103 are mutually movable toward the inside of the door frame structure 101, so that the door frame structure 101 itself absorbs the contact pressure.

Therefore, even if the door frame structure 101 and the door 105 come into contact with each other due to an earthquake, the door 105 can be opened and emergency evacuation is enabled.

PRIOR ART DOCUMENT

Patent Literature

Patent Literature 1: Japanese Published Unexamined Patent Application Ko. H10-18723

SUMMARY OF THE INVENTION

Problems to he Solved by the Invention

As disclosed in Patent Literature 1 described above, by constructing the frame members movably and interposing the coil spring between the frame members, even if relative story displacement of a skeleton occurs due to an earthquake or the like and the door and the door frame structure come into contact with each other, a certain contact pressure can be absorbed, so that the door can be opened and closed.

On the other hand, in the door frame structure disclosed in Patent Literature 1, respective frame members constituting the door frame structure are joined in a movable manner, so that the rigidity of the door frame structure is very low. In addition, the door frame structure is firmly mounted by welding, adhesion, or the like to a wall in which a wall opening is formed, so that the door frame structure is displaced along with the skeleton. Therefore, if the door frame structure excessively deforms due to oscillation in the event of an earthquake, the contact pressure between the door frame structure and the door exceeds the predetermined pressure, and the contact pressure cannot be absorbed by the coil spring and the door frame structure, and may not allow the door to be opened.

In addition, due to the low rigidity off the door frame structure, not only may the respective frame members fracture due to oscillation in the event of an earthquake, but also the respective frame members may fracture in normal use due to deterioration caused by repeated opening and closing of the door.

The present invention was made in view of the above-described problems, and an object thereof is to provide a door frame structure and a method for mounting the door frame structure which improve rigidity, prevent deformation that is caused by relative story displacement of a building in the event of an earthquake, and enable easy mounting.

Means for Solving the Problems

A door frame structure according to the present invention includes: a first frame body that has a first groove portion recessed along outer peripheries of at least three sides of a rectangular frame, and a first coupling portion near the first groove portion; a first reinforcing member that is installed at a predetermined position in the first groove portion and has a first projection formed thereon; a second frame body that has a second groove portion recessed along outer peripheries of at least three sides of a rectangular frame and a second coupling portion that can be coupled to the first frame body in a state where they face each other near the second groove portion; and a second reinforcing member that is installed at a predetermined position in the second groove portion and has a second projection formed thereon.

Here, by recessing the first groove portion along outer peripheries of at least three sides of the first frame body being a rectangular frame, the first reinforcing member described later is installed therein. With such a structure, rigidity of the first frame body may be improved, and possibility of displacement of the first frame body that is caused by opening and closing of a door installed on an inner periphery of the first frame body or by lateral vibration in the event of an earthquake, etc., can be minimized.

In addition, by providing the first coupling portion near the first groove portion, the second frame body described later can be coupled to the first frame body in a state where the second frame body faces the first frame body. With such a structure, rigidity of the door frame as a whole can be improved by integrating the first frame body and the second frame body.

Furthermore, by forming a first projection on the first reinforcing member, rigidity of the first reinforcing member itself can be improved. Therefore, even when strong lateral vibration occurs in the event of an earthquake, the first reinforcing member can be prevented from fracturing.

In addition, by recessing the second groove portion along outer peripheries of at least three sides of the second frame body, which may be a rectangular frame, a second reinforcing member described later can be installed therein. In this way, rigidity of the second frame body can be improved, and displacement of the second frame body that is caused by opening and closing of a door installed on an inner periphery of the second frame body or by lateral vibration in the event of an earthquake, etc., can be minimized.

In addition, by providing the second coupling portion that can be coupled to the first frame body in a state where they face each other, rigidity of the door frame as a whole can be improved by integrating the first frame body and the second frame body in a state where they face each other.

By forming the second projection on the second reinforcing member, rigidity of the second reinforcing member itself can be improved. Therefore, even when great lateral vibration occurs in the event of an earthquake, the second reinforcing member can be prevented from fracturing.

According to another embodiment of the present invention, a door frame structure according to the present invention includes: a first frame body that has a first groove portion recessed along an outer periphery of a jamb and a first coupling portion near the first groove portion; a first reinforcing member that is installed at a predetermined position in the first groove portion and has a first projection formed thereon; a second frame body that has a second groove portion recessed along an outer periphery of a jamb and a second coupling portion that can be coupled to the first frame body in a state where they face each other near the second groove portion; and a second reinforcing member that is installed at a predetermined position in the second groove portion, and has a second projection formed thereon.

Here, by recessing the first groove portion along the outer periphery of the jamb of the first frame body, the first reinforcing member described later can be installed therein. Accordingly, rigidity of the first frame body is improved, and possibility of displacement of the first frame body that is caused by opening and closing operation of a door installed on an inner periphery of the first frame body or by lateral vibration in the event of an earthquake, etc., can be minimized.

In addition, by providing the first coupling portion near the first groove portion, the second frame body described later can be coupled to the first frame body in a state where the second frame body faces the first frame body. Accordingly, rigidity of the door frame as a whole can be improved by integrating the first frame body and the second frame body.

In addition, by forming a first projection on the first reinforcing member, rigidity of the first reinforcing member itself can be improved. Therefore, even when great lateral vibration occurs in the event of an earthquake, the first reinforcing member can foe prevented from fracturing.

In addition, by recessing the second groove portion along an outer periphery of the jamb of the second frame body, the second reinforcing member described later can be installed therein. Accordingly, rigidity of the second frame body can be improved, and displacement of the second frame body that is caused by opening and closing operation of a door installed on an inner periphery of the second frame body or by lateral vibration in the event of an earthquake, etc., can be minimized.

In addition, by providing the second coupling portion that can be coupled to the first frame body in a state where they face each other near the second groove portion, rigidity of the door frame as a whole can be improved by integrating the first frame body and the second frame body in a state where they face each other.

In addition, by forming a second projection on the second reinforcing member, rigidity of the second reinforcing member itself can be improved. Therefore, even when great lateral vibration occurs in the event of an earthquake, the second reinforcing member can be prevented from fracturing.

In addition, in a case where the first coupling portion is provided to extend from the first groove portion, the first coupling portion and the first groove portion can be formed integrally, so that even if a stress is applied to the first frame body by opening and closing operation of the door or by lateral vibration in the event of an earthquake, etc., the first coupling portion may hot come off the first frame body. Further, the first groove portion and the first coupling portion can be manufactured in a series of processes, so that the manufacturing cost and manufacturing man-hours can also be reduced.

In addition, in a case where the second coupling portion is provided to extend from the second groove portion, the second coupling portion and the second groove portion can be formed integrally, so that even if a stress is applied to the second frame body by opening and closing operation of the door or by lateral vibration in the event of an earthquake, etc., the second coupling portion may not come off the second frame body. In addition, the second groove portion and the second coupling portion can be manufactured in a series of processes, so that the manufacturing cost and manufacturing man-hours can also be reduced.

In addition, in a case where the first coupling portion and the second coupling portion are provided to ex tend from the first groove portion and the second groove portion, and one of the first and second coupling portions is a recessed piece portion and the other is a projecting piece portion capable of being fitted in the recessed piece portion, the first frame body and the second frame body can be reliably coupled together in a state where they face each other by using the recessed piece portion or projecting piece portion as a mark and fitting these. Further, only by fitting the recessed piece portion and the projecting piece portion, the first frame body and the second frame body can be coupled together, so that a special tool, etc., is not required for coupling, and easy assembling is enabled.

In addition, in a case where the door frame structure includes a wall having a wall opening formed in which the first frame body and the second frame body are fitted, and a mounting angle that includes at least two surfaces one of which is fixed to the first reinforcing member and the other of which is fixed to an inner periphery of the wall, the first frame body including the first reinforcing member and the second frame body coupled to the first frame body can be mounted to the wall via the mounting angle.

In addition, in a case where the first reinforcing member is installed slidably with respect to the first groove portion, even if great relative story displacement of the wall occurs due to, for example, great lateral vibration in the event of an earthquake, the first reinforcing member coupled to the mounting angle slides in the first groove portion, so that the first frame body and the second frame body coupled to the first frame body do not follow the relative story displacement of the wall. In addition, since the second reinforcing member is fixed to the inside of the second groove portion, rigidity of the second frame body is maintained. Therefore, deformations of the first frame body and the second frame body caused by lateral vibration in the event of an earthquake can be minimized, so that the door can be opened and closed even in an emergency.

In addition, in a case where the first reinforcing member has a first contact surface that comes into contact with at least one side wall of the first groove portion, even if a predetermined or greater force is applied to the first reinforcing member by lateral vibration in the event of an earthquake, the force applied to the first reinforcing member can be dispersed from the first contact surface, so that the first reinforcing member can be prevented from fracturing.

In addition, in a case where the first reinforcing member has a second contact surface that comes into contact with the mounting angle, the first frame body on which the first reinforcing member is installed can be mounted to the wall opening via the mounting angle.

Further, since the first frame body is not directly mounted to a wall, even if great relative story displacement of the wall occurs due to, for example, great lateral vibration in the event of an earthquake, the first reinforcing member fixed to the mounting angle slides in the first groove portion, and the first frame body and the second frame body do not follow the relative story displacement of the wall. Therefore, deformations of the first frame body and the second frame body caused by the lateral vibration in the event of an earthquake can be minimized, and accordingly, the door can be opened and closed even in an emergency.

In addition, in a case where the first reinforcing member includes a first joint plate that joins the first contact surface and the second con tact surface, and is across the first groove portion, the first joint plate functions as a longitudinal rib, so that rigidity of the first frame body can be improved.

In addition, in a case where a first projection is formed on the first joint plate, rigidity of the first joint plate can be improved, and therefore, for example, even if great lateral vibration occurs in the event of an earthquake, the first reinforcing member can be prevented from fracturing.

In addition, in a case where the first projection is formed in a 30-70% area of the joint plate, the compatibility between processability when processing the first projection and rigidity of the first joint plate can be ensured in an optimally-balanced manner. That is, if the area of the first projection is smaller than 30% of the first joint plate, the rigidity of the first joint plate cannot be kept at a predetermined or higher level, and if the area is larger than 70%, processing for forming the first projection becomes difficult.

In addition, in a case where the second reinforcing member includes a third contact surface that comes into contact with one side wall of the second groove portion and a fourth contact surface that comes into contact with the other side wall of the second groove portion, the second reinforcing member is installed in the second groove portion in a contact state, so that the rigidity of the second frame body can be improved.

Further, even when a predetermined or greater force is applied to the second reinforcing member by lateral vibration in the event of an earthquake, the force applied to the second reinforcing member can be dispersed from the second contact surface, so that the second reinforcing member can be prevented from fracturing.

In addition, in a case where the second reinforcing member includes a second joint plate that joins the third contact surface and the fourth contact surface, and is across the second groove portion, this second joint plate functions as a longitudinal rib, so that rigidity of the second frame body can be improved.

In addition, in a case where a second projection is formed on the second joint plate, rigidity of the second joint plate can be improved, so that, for example, even in a case where great lateral vibration occurs in the event of an earthquake, the second reinforcing member can be prevented from fracturing.

In addition, in a case where the second projection is formed in a 30-70% area of the joint plate, the compatibility between processability when processing the second projection and the rigidity of the second joint plate can be ensured in an optimally balanced manner. That is, if the area of the second projection is smaller than 30% of the second joint plate, the rigidity of the second joint plate cannot be kept at a predetermined or higher level, and if the area is larger than 70%, processing for forming the second projection becomes difficult.

In addition, in a case where the first reinforcing member or the second reinforcing member has a notched portion that comes into contact with an outer surface of the recessed piece portion when the projecting piece portion is fitted in the recessed piece portion, the first frame body and the second frame body can be more firmly coupled together. Further, even if a predetermined or greater force is applied to the first reinforcing member or the second reinforcing member by lateral vibration in the event of an earthquake, the force applied to the first reinforcing member or the second reinforcing member can be dispersed from the outer peripheral surface of the recessed piece portion in contact, so that the first reinforcing member or the second reinforcing member can be prevented from fracturing.

In addition, in a case where the first frame body includes a pair of first frame members and a second frame member that joins one ends of the first frame members, transportation, assembling, and disassembling of the first frame body become easy, and the first frame body can also be reused.

In addition, in a case where the second frame body includes a pair of third frame members and a fourth frame member that joins one ends of the third frame members, transportation, assembling, and disassembling of the second frame body become easy, and the second frame body can also be reused.

In addition, in a case where equal numbers of the first reinforcing members are respectively disposed on the first frame members and the second frame member, rigidity of the whole first frame body can be evenly balanced.

In addition, in a case where equal numbers of the second reinforcing members are respectively disposed on the third frame members and the fourth frame member, rigidity of the whole second frame body can be evenly balanced.

In order to attain the above-described object, a method for mounting a door frame structure according to the present invention includes the steps of installing a first reinforcing member in a first groove portion formed along outer peripheries of at least three sides of a first frame body being a rectangular frame, fixing one surface of a mounting angle having at least two surfaces to the first reinforcing member and fixing the other surface to an inner periphery of a wall in which a wall opening is formed, installing a second reinforcing member in a second groove portion formed along outer peripheries of at least three sides of a second frame body being a rectangular frame, and coupling the first frame body and the second frame body so that they face each other.

Here, since the method includes the step of installing the first reinforcing member in the first groove portion formed along outer peripheries of at least three sides of a rectangular frame, rigidity of the first frame body can be improved, and displacement of the first frame body that is caused by opening and closing operation of a door installed on an inner periphery of the first frame body or lateral vibration in the event of an earthquake, etc., can be minimized.

In addition, by forming a first projection on the first reinforcing member, rigidity of the first reinforcing member itself can be improved. Therefore, even if great lateral vibration occurs in the event of an earthquake, the first reinforcing member can be prevented from fracturing.

In addition, since the method includes the step of fixing one surface of the mounting angle having at least two surfaces to the first reinforcing member and fixing the other surface to an inner periphery of a wall in which a wall opening is formed, the first frame body including the first reinforcing member can be coupled to the wall via the mounting angle.

In addition, since the method includes the step of installing the second reinforcing member in the second groove portion formed along outer peripheries of at least three sides of a second frame body being a rectangular frame, rigidity of the second frame body can be improved, and displacement of the second frame body that is caused by opening and closing operation of a door installed on an inner periphery of the second frame body or lateral vibration in the event of an earthquake, etc., can be minimized.

In addition, by forming a second projection on the second reinforcing member, rigidity of the second reinforcing member itself can be improved. Therefore, even if great lateral vibration occurs in the event of an earthquake, the second reinforcing member can be prevented from fracturing.

In addition, since the method includes the step of coupling the first frame body and the second frame body in a state where they face each other, rigidity of the door frame as a whole can be improved by integrating the first frame body and the second frame body.

In order to attain the above-described object, a method for mounting a door frame structure includes the steps of installing a first reinforcing member in a first groove portion formed along an outer periphery of a first frame body being a jamb, fixing one surface of a mounting angle having at least two surfaces to the first reinforcing member and fixing the other surface to an inner periphery of a wall in which a wall opening is formed, installing a second reinforcing member in a second groove portion formed along an outer periphery of a second frame body being a jamb, and coupling the first frame body and the second frame body so that they face each other.

Here, since the method includes the step of installing a first reinforcing member in a first groove portion formed along an outer periphery of a jamb, rigidity of the first frame body is improved, and displacement of the first frame body that is caused by opening and closing operation of a door installed on an inner periphery of the first frame body or lateral vibration in the event of an earthquake, etc., can be minimized.

In addition, by forming a first projection on the first reinforcing member, rigidity of the first reinforcing member itself can be improved. Therefore, even when great lateral vibration occurs in the event of an earthquake, the first reinforcing member can foe prevented from fracturing.

In addition, since the method includes the step of fixing one surface of a mounting angle having at least two surfaces to the first reinforcing member and fixing the other surface to an inner periphery of a wall opening formed in a wall, the first frame body including the first reinforcing member can be coupled to the wall via the mounting angle.

In addition, since the method includes the step of installing a second reinforcing member in a second groove portion formed along outer peripheries of at least three sides of a second frame body being a rectangular frame, rigidity of the second frame body can be improved, and displacement of the second frame body that is caused by opening and closing operation of a door installed on an inner periphery of the second frame body or lateral vibration in the event of an earthquake, etc., can be minimized.

In addition, by forming a second projection on the second reinforcing member, rigidity of the second reinforcing member itself can be improved. Therefore, even if great lateral vibration occurs in the event of an earthquake, the second reinforcing member can be prevented from fracturing.

In addition, since the method includes the step of coupling the first frame body and the second frame body in a state where they face each other, rigidity of the door frame as a whole can be improved by integrating the first frame body and the second frame body.

In addition, in a case where the step of installing the first reinforcing member includes a step of installing the first reinforcing member slidably with respect to the first groove portion, and the step of installing the second reinforcing member includes a step of fixing the second reinforcing member with respect to the second groove portion, even if great relative story displacement of the wall occurs due to, for example, great lateral vibration in the event of an earthquake, the first reinforcing member fixed to the mounting angle slides in the first groove portion, so that the first frame body and the second frame body coupled to the first frame body do not follow the relative story displacement of the wall. In addition, since the second reinforcing member is fixed to the inside of the second groove portion, rigidity of the second frame body is maintained. Therefore, deformations of the first frame body and the second frame body caused by lateral vibration in the event of an earthquake can be minimized, so that the door can be opened and closed even in an emergency.

Effects of the Invention

The door frame structure and the method for mounting the door frame structure according to the present invention improve rigidity, prevent deformation that is caused by relative story displacement of a building in the event of an earthquake, and enable easy mounting.

BRIEF DESCRIPTION OF THE DRAWINGS

FIG. 1 is an exploded perspective view of a door frame structure according to an embodiment of the present invention.

FIG. 2 is a front view of the door frame structure according to the embodiment of the present invention.

FIG. 3 is a perspective view of an inner frame body.

FIG. 4 are enlarged views of a first reinforcing member, and FIG. 4(*a*) is a front view, FIG. 4(*b*) is a side view, FIG. 4(*c*) is a bottom view, FIG. 4(*d*) is a perspective view, and FIG. 4(*e*) is a view showing a state where the first reinforcing member is installed in a first groove portion.

FIG. 5 is a perspective view of an outer frame body.

FIG. 6 are enlarged views of a second reinforcing member, and FIG. 6(*a*) is a front view, FIG. 6(*b*) is a side view, FIG. 6(*c*) is a bottom view, FIG. 6(*d*) is a perspective view, and FIG. 6(*e*) is a view showing a state where the second reinforcing member is installed in a second groove portion.

FIG. 7(*a*) is a vertical sectional view of a second frame member portion and FIG. 7(*b*) is a cross-sectional view of first frame member portions in the door frame structure according to the embodiment of the present invention.

FIG. 8 are enlarged views of a mounting angle, and FIG. 8(*a*) is a front view, FIG. 8(*b*) is a side view, FIG. 8(*c*) is a bottom view, FIG. 8(*d*) is a perspective view, and FIG. 8(*e*) is a view showing a state where the mounting angle is fixed to the first reinforcing member.

FIG. 9 is a view showing a conventional technique.

BEST MODE FOR CARRYING OUT THE INVENTION

Hereinafter, embodiments of the present invention relating to a door frame structure and a method for mounting the door frame structure are described with reference to the drawings for understanding of the present invention. In each drawing, for convenience of description, in a state where a door frame structure is installed on a floor surface, an upward direction of the door frame structure from the floor surface is defined as a vertical direction, and a longer direction of the door frame structure perpendicular to the upward direction is defined as a horizontal direction.

First, FIG. 1 depicts an exploded view of an embodiment of the present invention. As shown in FIG. 1, the door frame structure 1 includes an inner frame body 2 ("first frame body" described in claims) and an outer frame body 3 ("second frame body" described in claims). The inner frame body 2 includes a pair of first frame members 2*a* and 2*b* extending in the vertical direction and a second frame member 2*c* that joins one end of each of the first frame members 2*a* and 2*b* and extends in the horizontal direction, and the first frame members 2*a* and 2*b* and the second frame member 2*c* are fixed by welding, adhesion, fitting, or other known fixing means, respectively.

Here, the inner frame body 2 does not necessarily have to be divisionally constructed of the first frame members 2*a* and 2*b* and the second frame member 2*c*, respectively, and these frame members may be constructed integrally. However, divisional construction makes transportation, assembling, and disassembling easy, and also enables reuse, so that divisional construction is more preferable.

In addition, each of the first frame members 2*a* and 2*b* and the second frame member 2*c* has a first groove portion 7 recessed in an outer periphery thereof so as to have a substantially half-split sectional shape.

Further, in the first groove portion 1, a first reinforcing member 9 (not shown in FIG. 1) described later is installed so as to be slidable in the first groove portion 7.

Similarly, the outer frame body 3 includes a pair of third frame members 3*a* and 3*b* extending in the vertical direction, and a fourth frame member 3*c* that joins one end of each of the third frame members 3*a* and 3*b* and extends in the horizontal direction, and the third frame members 3*a* and 3*b* and the fourth frame member 3*c* are fixed by welding, adhesion, fitting, or other known fixing means, respectively, Here, the outer frame body 3 does not necessarily have to be divisionally constructed of the third frame members 3*a* and 3*b* and the fourth frame member 3*c*, respectively, and these frame members may be constructed integrally. However, divisional construction makes transportation, assembling, and disassembling easy, and also enables reuse, so that divisional construction is more preferable.

In addition, each of the third frame members 3*a* and 3*b* and the fourth frame member 3*c* has a second groove portion 8 recessed in an outer periphery thereof so as to have a substantially half-split sectional shape.

Further, in the second groove portion 8, a second reinforcing member 10 (not shown in FIG. 1) described later is installed.

In a wall 4, a wall opening 5 Is formed, and a pair of post members 6*a* and 6*b* extending in the vertical direction along an inner periphery of the wall 4 and a beam member 6*c* extending in the horizontal direction are embedded in the wall 4. In such a state, into the wall opening 5, the inner frame body 2 is fitted from one side of the wall opening 5 and the outer frame body 3 is fitted from the other side. At this time, the post members 6*a* and 6*b* and the beam member 6*c* only come into contact with the door frame structure 1, and as described later, they are partially Indirectly fixed to each other via mounting angles 11.

Here, the post members 6*a* and 6*b* and the beam member 6*c* do not necessarily have to be indirectly fixed to the door frame structure 1, and the post members 6*a* and 6*b* and the beam member 6*c* may be directly fixed to the door frame structure 1 by welding or the like. However, by indirectly fixing the post members 6*a* and 6*b* and the beam member 6*c* to the door frame structure 1, even if relative story displacement of the wall 4 occurs due to oscillation in the event of an earthquake, without following displacement of the wall 4, displacement amount of the door frame structure 1 can be minimized. Therefore, it is more preferable that the post members 6*a* and 6*b* and the beam member 6*c* are indirectly fixed to the door frame structure 1.

Around the door frame structure 1 mounted to the wall surface 4 by being fitted in the wall opening 5, as shown in FIG. 2, the first reinforcing members 9 and second reinforcing members 10 are provided, and a door 31 enabled to freely open and close by hinges 32 attached to two positions is held.

Here, the hinges 32 do not necessarily have to be provided at two positions, and the number of hinges may be properly changed according to the size of the door 31.

As the inner frame body 2, as shown in FIG. 3, a frame body being jamb inverted U-shaped as a whole is formed by laying the second frame member 2*c* across upper ends of the pair of left and right first frame members 2*a* and 2*b*, and the first groove portions 7 are connected to be along the vertical directions of the first frame members 2*a* and 2*b* and the horizontal direction of the second frame member 2*c*.

Here, the inner frame body 2 does not necessarily have to be formed as an inverted U-shaped jamb. For example, the inner frame body 2 may be substantially H-shaped by laying the second frame member 2*c* across positions slightly lower than the upper ends of the first frame members 2*a* and 2*b*. Further, it is also possible that another frame member is laid on the floor surface F side (lower end sides of the first frame members 2*a* and 2*b*) to form a rectangular frame as a whole.

In the first groove portions 7, the first reinforcing members 9 substantially matching sectional shapes of the first groove portions 7 are installed like longitudinal ribs across the first groove portions 7 so as to be slidable in the vertical directions of the first frame members 2*a* and 2*b* and the horizontal direction of the second frame member 2*c*. Equal numbers among 2 to 15 of the first reinforcing members 9 are respectively installed on the first frame members 2*a* and 2*b* and the second frame member 2*c*, and on the inner frame body 2, 6 to 45 in total of first reinforcing members 9 are installed. In addition, the first reinforcing member 9 is mounted to the wall opening 5 not shown in FIG. 3 via a mounting angle 11 described later.

Here, the numbers of first reinforcing members 9 installed on the first frame members 2*a* and 2*b* and the second frame member 2*c*, respectively, do not necessarily have to be equal to each other. For example, the number of first reinforcing members 9 to be installed on each of the first frame members 2*a* and 2*b* may be set smaller than that installed on the second frame member 2*c*, or vice versa. However, from the viewpoint of minimizing displacement in the horizontal direction in the event of an earthquake, the rigidity balance of the whole inner frame body 2 must be ensured, so that it is preferable that in consideration of lengths, etc., of the first frame members 2*a* and 2*b* and the second frame member 2*c*, the disposition balance of the first reinforcing members 9 to be installed is properly changed.

In addition, the number of first reinforcing members 9 does not necessarily have to be 2 to 15 per frame member. The number can be properly changed in consideration of the sire and required rigidity, etc., of the whole inner frame body 2.

Next, a detailed shape of the first reinforcing member 9 is described with reference to FIG. 4. The first reinforcing member 9 has a first contact surface 12 and a second contact surface 13 that are formed by folding, and a first joint plate 14 joining these first contact surface 12 and second contact surface 13. The first joint plate 14 is a flat plate with a plate thickness of approximately 1 to 2 mm, and has a whole shape that can be fitted in the first groove portion 7 formed on the inner frame body 2 as shown in FIG. 4(*e*), and is properly changeable according to the shape of the first groove portion 7.

In addition, in a predetermined range of the first joint plate 14, first projections 15 are formed by drawing. Drawing is applied to a 30-70% area of the first joint plate 14.

Here, the range in which the projections 15 are formed does not necessarily have to be set to a 30-70% area of the first joint plate 14. However, as a result of repeated experiments conducted by the inventor, when the area was smaller than 30%, rigidity could not be greatly improved, and when the area was larger than 70%, processability was deteriorated. Therefore, it was found that by setting the area to 30-70%, preferably, to 50-70%, an optimal balance between processability and rigidity is obtained.

The first contact surface 12 is brought into contact with one side wall 16*a* of the first groove portion 7, and the second contact surface 13 is brought into contact with one end of the mounting angle 11 described later to be mounted to the wall 4.

Here, the first reinforcing member 9 does not necessarily have to have the first contact surface 12. However, when the first reinforcing member 9 has the first contact surface 12, even if a predetermined or greater force is applied to the first reinforcing member 9 in the event of an earthquake, etc., the force applied to the first reinforcing member 9 can be dispersed through the first contact surface 12, and the first reinforcing member 9 can be prevented from fracturing in advance.

In addition, the first contact surface 12 does not necessarily have to be in contact with the side wall 16*a* of the first groove portion 7. For example, it is also possible that a predetermined space is provided between the first contact surface 12 and the side wall 16*a* of the first groove portion 7, and they come into contact with each other only when the first reinforcing member 9 is subjected to a force and displaced inside the first groove portion 7.

To L-shape-folded portions from which the first contact surface 12 and the second contact surface 13 are formed, triangular ribs 17 for securing strength are attached.

Here, the triangular ribs 17 do not necessarily have to be provided. However, fragile root portions of the L shapes can be reinforced by the triangular ribs 17.

Next, as the outer frame body 3, as shown in FIG. 5, a jamb that is inverted U-shaped as a whole is formed by laying the third frame member 3*c* across upper ends of the pair of left and right third frame members 3*a* and 3*b*, and the second groove portions 8 are connected to be along the vertical directions of the third frame members 3*a* and 3*b* and the horizontal direction of the fourth frame member 3*c*.

Here, the outer frame member 3 does not necessarily have to be formed into an inverted U-shaped jamb. For example, the outer frame body 3 may be substantially H-shaped by laying the fourth frame member 3*c* across portions slightly lower than the upper ends of the third frame members 3*a* and 3*b*. Further, it, is also possible that another frame member is laid on the floor surface F side (lower end sides of the third frame members 3*a* and 3*b*) to form a frame body that is rectangular as a whole.

In the second groove portions 8, second reinforcing members 10 substantially matching sectional shapes of the second groove portions 8 are installed like longitudinal ribs across the second groove portions 8. Equal numbers among 2 to 15 of the second reinforcing members 10 are respectively installed on the third frame members 3*a* and 3*b* and the fourth frame member 3*c*, and 6 to 45 second reinforcing members 10 in total are installed on the outer frame body 3.

Here, the numbers of second reinforcing members 10 installed on the third frame members 3*a* and 3*b* and the fourth frame member 3*c*, respectively, do not necessarily have to be equal to each other. For example, the number of second reinforcing members 10 to be installed on each of the third frame members 3*a* and 3*b* may be set to be smaller than that on the fourth frame member 3*c*, or vice versa. However, from the viewpoint of minimizing displacement in the horizontal direction in the event of an earthquake, the rigidity balance of the whole outer frame body 3 must be ensured, so that it is preferable that in consideration of the lengths, etc., of the third frame members 3*a* and 3*b* and the fourth frame member 3*c*, the disposition balance of the second reinforcing members 10 to be installed is properly changed.

The number of second reinforcing members 10 does not necessarily have to be 2 to 15 per frame member. The number can be properly changed in consideration of the size and required rigidity, etc., of the whole outer frame body 3.

Next, a detailed shape of the second reinforcing member 10 is described with reference to FIG. 6. The second reinforcing member 10 has a third contact surface 18 and a fourth contact surface 19 formed By folding, and a second joint plate 20 joining these third contact surface 18 and fourth contact surface 19. The second joint plate 20 is a flat plate with a plate thickness of 1 to 2 mm, and has a whole shape that can be fitted in the second groove portion 8 formed on the outer frame body 3 as shown in FIG. 6(*e*), and is properly changeable according to the shape of the second groove portion 8.

In a predetermined range of the second joint plate 20, a second projection 21 is formed by drawing. Drawing is applied to a 30-70% area of the second joint plate 20.

Here, the range in which the projection 21 is formed does not necessarily have to be set to a 30-70% area of the second joint plate 20. However, as a result of repeated experiments conducted by the inventor, if the area was smaller than 30%, rigidity could not be greatly improved, and if the area was larger than 70%, processability was deteriorated. Therefore, it was found that by setting the area to 30-70%, preferably, to 50-70%, an optimal balance between processability and rigidity is obtained.

The third contact surface 18 and the fourth contact surface 19 are brought into contact with side walls 22*a* and 22*b* of the second groove portion 8, and near the third contact surface 18, a notched portion 30 is formed so that a part of the second joint plate 20 comes into contact with a part of the inner frame body 2 when the inner frame body 2 and the outer frame body 3 are coupled in a state where they face each other. Further, the fourth contact surface 19 is screwed and fixed to the side wall 22*b* of the second groove portion 8. As shown in the figure drawings, "near" may mean "adjacent to" in describing features of the present invention.

Here, the second reinforcing member 10 does not necessarily have to have the third contact surface 18 and the fourth contact surface 19. However, when the second reinforcing member has the third contact surface 18 and the fourth contact surface 19, the second reinforcing member 10 is firmly fixed in the second groove portion 8. Further, even if a predetermined or greater force is applied to the second reinforcing member 10 in the event of an earthquake, etc., the force applied to the second reinforcing member 10 can be dispersed through the third contact surface 18 and the fourth contact surface 19, and the second reinforcing member 10 can be prevented from fracturing in advance.

In addition, the second reinforcing member 10 does not necessarily have to have the notched portion 30. However, when the second reinforcing member 10 has the notched portion 30, frictional resistance between the notched portion 30 and the inner frame body 2 increases, so that the inner frame body 2 and the outer frame body 3 are more firmly joined together.

In addition, the second reinforcing member 10 does not necessarily have to be fixed to the second groove portion 8.

For example, it is also possible that the third contact surface 18 and the fourth contact surface 19 are only in contact with the side walls 22*a* and 22*b* of the second groove portion 8, respectively. However, by fixing the second reinforcing member 10 to the second groove portion 8, rigidity of the second frame body that is displaced integrally with the first frame body by, for example, great lateral vibration in the event of an earthquake is maintained, and deformations of the first frame body and the second frame body caused by lateral vibration in the event of an earthquake can be minimized, so that the door can be opened and closed even in an emergency.

To the L-shape-folded portion from which the fourth contact surface 19 is formed, triangular ribs 23 for securing strength are attached.

Here, the triangular ribs 23 do not necessarily have to be attached. However, by the triangular ribs 23, the fragile root portion of the L shape can be reinforced.

Next, a mounting state of the inner frame body 2 and the outer frame body 3 to the wall 4 in which the wall opening 5 is formed is described with reference to FIG. 7. The inner frame body 2 and the outer frame body 3 are firmly coupled by fitting projecting piece portions 25 provided to extend from the side walls 22*a* of the second groove portions 8 of the outer frame body 3 in the recessed piece portions 24 provided to extend from side walls 16*b* of the first groove portions 7 of the inner frame body 2.

Here, the inner frame body 2 and the outer frame body 3 do not necessarily have to be coupled by the method in which the recessed piece portions 24 and the projecting piece portions 25 are fitted to each other. For example, the inner frame body 2 and the outer frame body 3 may be coupled by a known fixing method such as welding, adhesion, or screwing, etc. However, by fitting and coupling the recessed piece portions 24 and the projecting piece portions 25, they can be used as a mark when coupling the outer frame body 3 to the inner frame body 2, and processes such as welding, adhesion, and screwing, etc., after assembling are unnecessary, so that the assembling process becomes easy.

In addition, it is not necessarily required that the recessed piece portions 24 are formed on the inner frame body 2 and the projecting piece portions 25 are formed on the outer frame body 3. For example, it is also possible that the projecting piece portions 25 are formed on the inner frame body 2, and the recessed piece portions 24 are formed on the outer frame body 3.

One surface of the L-shaped mounting angle 11 is brought into contact with and screwed and fixed to the second contact surface 13 of the first reinforcing member 9, and the other surface of the mounting angle 11 is brought into contact with the wall 4 and screwed and fixed to the post members 6*a* and 6*b* and the beam member 6*c*. That is, the door frame structure 1 is not directly fixed to the wall 4, and the first reinforcing members 9 installed slidably on the inner frame body 2 are mounted to the wall 4 via the mounting angles 11.

Here, one surface of the mounting angle 11 and the second contact surface 13 of the first reinforcing member 9, and the other surface of the mounting angle 11 and the wall 4 do not necessarily have to be screwed and fixed to each other. For example, they can be fixed by a known fixing method such as welding or adhesion, etc.

Next, a detailed shape of the mounting angle 11 is described with reference to FIG. 8. The mounting angle 11 is substantially L-shaped, and has a fifth contact surface 26 being a contact surface that comes into contact with the wall 4, and a sixth contact surface 27 that comes into contact with the second contact surface 13 of the first reinforcing member 9. The fifth contact surface 26 has a contact area larger than that of the sixth contact surface 27, and on the fifth contact surface 26, a fifth contact surface projection 28 is formed by drawing.

The contact area of the fifth contact surface 26 does not necessarily have to be set to be larger than the contact area of the sixth contact surface 27. However, by setting the contact area of the fifth contact surface 26 being a contact surface that comes into contact with the wall 4 to be larger than the contact area of the sixth contact surface 27, the mounting angle 11 can be prevented from coming off the wall 4 even when the wall 4 is greatly displaced in the event of an earthquake.

In addition, it is not necessarily required that drawing is applied to the fifth contact surface 26. However, the fifth contact surface 26 is directly subjected to a stress from the wall 4, so that by increasing the rigidity by drawing, the mounting angle 11 can be prevented from being fractured by the stress received from the wall 4.

To the L-shape-folded portion of the mounting angle 11, triangular ribs 29 for securing strength are attached.

Here, the triangular ribs 29 do not necessarily have to be attached. However, by the triangular ribs 29, the fragile root portion of the L shape can be reinforced.

As described above, the door frame structure 1 including the inner frame body 2 and the outer frame body 3 is indirectly mounted to the wall 4 via the first reinforcing members 9 slidably installed on the inner frame body 2 and the mounting angles 11.

Therefore, in normal use, rigidity of the door frame structure 1 can be improved by the first reinforcing members 9 and the second reinforcing members 10. On the other hand, even if great relative story displacement of the wall 4 occurs due to lateral vibration in the event of an earthquake, etc., the door frame structure 1 does not deform by following the relative story displacement of the wall 4. Therefore, deformation of the door frame structure 1 with respect to relative story displacement of the wall 4 can be minimized, so that the door can be opened and closed even in an emergency.

Next, a method for mounting the door frame structure 1 to the wall opening 5 is described.

<STEP 1: Step of Installing the First Reinforcing Members 9 on the Inner Frame Body 2>

On the first frame members 2*a* and 2*b* and the second frame member 2*c*, the first reinforcing members 9 are respectively installed slidably in the first groove portions 7.

<STEP 2: Step of Bringing into Contact and Fixing the Mounting Angles 11 to the First Reinforcing Members 9>

The sixth contact surfaces 27 of the mounting angles 11 are brought into contact with and screwed and fixed to the second contact surfaces 13 of the first reinforcing members 9 respectively installed on the first frame members 2*a* and 2*b* and the second frame member 2*c*.

Here, the second contact surfaces 13 and the sixth contact surfaces 27 do not necessarily have to be screwed and fixed. For example, they can be fixed by a known fixing means such as adhesion, welding, and caulking, etc.

<STEP 3: Step of Assembling the First Frame Members 2*a* and 2*b* and the Second Frame Member 2*c*>

The second frame member 2*c* is assembled to one ends of the first frame members 2*a* and 2*b* to form the inner frame body 2 being a jamb.

Here, in a case where the first frame members 2*a* and 2*b* and the second frame member 2*c* are formed integrally, the step of <STEP 3> is unnecessary.

In addition, to form a rectangular frame having four sides, another frame member may further be added and joined to the other ends of the first frame members 2*a* and 2*b*.

<STEP 4: Step of Installing the Second Reinforcing Members 10 on the Outer Frame Body 3>

The second reinforcing members 10 are installed in the second groove portions 8 of the respective third frame members 3*a* and 3*b* and fourth frame member 3*c*.

<STEP 5: Step of Assembling the Third Frame Members 3*a* and 3*b* and the Fourth Frame Member 3*c*>

The fourth frame member 3*c* is assembled to one ends of the third frame members 3*a* and 3*b* to form the outer frame body 3 being a jamb.

Here, in a case where the third frame members 3*a* and 3*b* and the fourth frame member 3*c* are formed integrally, the step of <STEP 5> is unnecessary.

In addition, to forma rectangular frame having four sides, another frame member may further be added and joined to the other ends of the third frame members 3*a* and 3*b*.

<STEP 6: Step of Assembling the Inner Frame Body 2 to the Wall 4>

The inner frame body 2 to which the first reinforcing members 9 are fixed is fitted in the wall opening 5 from one side.

<STEP 7: Step of Mounting the Mounting Angles 11 to the Wall 4>

The fifth contact surfaces 26 of the mounting angles 11 fixed to the second contact surfaces 13 of the first reinforcing members 9 are screwed and fixed to the wall 4.

Here, the fifth contact surfaces 26 do not necessarily have to be screwed and fixed to the wall 4. For example, the fifth contact surfaces 26 may be fixed by a known fixing means such as adhesion, welding, and caulking, etc.

<STEP 8: Step of Coupling the Outer Frame Body 3 to the Inner Frame Body 2>

The outer frame body 3 is fitted in the wall opening 5 from the other end side of the wall opening 5 so as to face the inner frame body 2. At this time, by fitting the projecting piece portions 25 formed on the outer frame body 3 in the recessed piece portions 24 formed on the inner frame body 2, the inner frame body 2 and the outer frame body 3 are coupled together.

As described above, the door frame structure and the method for mounting the door frame structure to which the present invention is applied improve the rigidity, prevent deformation that is caused by relative story displacement of a building in the event of an earthquake, and enable easy mounting.

DESCRIPTION OF REFERENCE SYMBOLS

1, 101 Door frame structure
2 Inner frame body
2*a*, 2*b* First frame member
2*c* Second frame member
3 Outer frame body
3*a*, 3*c* Third frame member
3*c* Fourth frame member
4 Wall
5 Wall opening
6*a*, 6*b* Post member
6*c* Beam member
7 First groove portion
8 Second groove portion
9 First reinforcing member
10 Second reinforcing member
11 Mounting angle
12 First contact surface
13 Second contact surface
14 First joint plate
15, 21, 28 Projection
16*a*, 16*b*, 22*a*, 22*b* Side wall
17, 23, 29 Triangular rib
18 Third contact surface
19 Fourth contact surface

20 Second joint plate
24 Recessed piece portion
25 Projecting piece portion
26 Fifth contact surface
27 Sixth contact surface
30 Notched portion
31, 106 Door
32 Hinge
102, 103 Frame member
104 Coil spring
F Floor surface

The invention claimed is:

1. A door frame structure comprising:

a first frame body having a first groove portion recessed along outer peripheries of at least three sides of a frame, and a first coupling portion adjacent to the first groove portion;

a first reinforcing member that is installed at a predetermined position in the first groove portion, and has a first projection formed thereon;

a second frame body having a second groove portion recessed along outer peripheries of at least three sides of a frame, and a second coupling portion that couples to the first coupling portion of the first frame body, wherein the first frame body and the second frame body substantially align with each other and the second coupling portion is disposed adjacent to the second groove portion;

a second reinforcing member that is installed at a predetermined position in the second groove portion, and has a second projection formed thereon;

a wall having a wall opening formed in which the first frame body and the second frame body are fitted; and a mounting angle including at least two surfaces one of which is fixed to the first reinforcing member and another of which is fixed to an inner periphery of the wall, wherein the mounting angle is a unitary piece, the first reinforcing member is installed slidably with respect to the first groove portion, and the second reinforcing member is fixed with respect to the second groove portion.

2. The door frame structure according to claim 1, wherein the first coupling portion and the second coupling portion extend from the first groove portion and the second groove portion, respectively, and one of the first and second coupling portions is a recessed piece portion and the other is a projecting piece portion capable of being fitted in the recessed piece portion.

3. The door frame structure according to claim 1, wherein the first reinforcing member includes:

a first contact surface that comes into contact with at least one side wall of the first groove portion, a second contact surface to which the mounting angle is fixed, and a first joint plate that joins the first contact surface and the second contact surface, and is across the first groove portion, and the first projection is formed on the first joint plate.

4. The door frame structure according to claim 3, wherein the first projection is formed on 30-70% of a surface of the first joint plate.

5. The door frame structure according to claim 1, wherein the second reinforcing member includes a third contact surface that comes into contact with at least one side wall of the second groove portion, a fourth contact surface that comes into contact with another side wall of the second groove portion, and a second joint plate that joins the third contact surface and the fourth contact surface, and is across the second groove portion, and the second projection is formed on the second joint plate.

6. The door frame structure according to claim 5, wherein the second projection is formed on 30-70% of a surface of the second joint plate.

7. The door frame structure according to claim 2, wherein the first reinforcing member or the second reinforcing member has a notched portion that comes into contact with an outer surface of the recessed piece portion when the projecting piece portion is fitted in the recessed piece portion.

8. The door frame structure according to claim 1, wherein the first frame body includes a pair of first frame members and a second frame member, wherein the first frame members face each other and the second frame member couples to respective ends of the first frame members, and the second frame body includes a pair of third frame members and a fourth frame member, wherein the third frame members face each other and the fourth frame member couples to respective ends of the first frame members.

9. The door frame structure according to claim 8, wherein equal numbers of the reinforcing members are respectively disposed on the first frame members and the second frame member, and equal numbers of the reinforcing members are respectively disposed on the third frame members and the fourth frame member.

10. A door frame structure comprising:

a first frame body having a first groove portion recessed along an outer periphery of a jamb, and a first coupling portion adjacent to the first groove portion;

a first reinforcing member that is installed at a predetermined position in the first groove portion, and has a first projection formed thereon;

a second frame body having a second groove portion recessed along an outer periphery of a jamb, and a second coupling portion that couples to the first coupling portion of the first frame body, wherein the first frame body and the second frame body substantially align with each other and the second coupling portion is disposed adjacent to the second groove portion;

a second reinforcing member that is installed at a predetermined position in the second groove portion, and has a second projection formed thereon;

a wall having a wall opening formed in which the first frame body and the second frame body are fitted; and a mounting angle including at least two surfaces one of which is fixed to the first reinforcing member and another of which is fixed to an inner periphery of the wall, wherein the mounting angle is a unitary piece, the first reinforcing member is installed slidably with respect to the first groove portion, and the second reinforcing member is fixed with respect to the second groove portion.

11. The door frame structure according to claim 10, wherein the first coupling portion and the second coupling portion extend from the first groove portion and the second groove portion, respectively, and one of the first and second coupling portions is a recessed piece portion and the other is a projecting piece portion capable of being fitted in the recessed piece portion.

12. The door frame structure according to claim 10, wherein the first reinforcing member includes:

a first contact surface that comes into contact with at least one side wall of the first groove portion, a second contact surface to which the mounting angle is fixed, and a first joint plate that joins the first contact surface and the second contact surface, and is across the first groove portion, and the first projection is formed on the first joint plate.

13. The door frame structure according to claim 12, wherein the first projection is formed on 30-70% of a surface of the first joint plate.

14. The door frame structure according to claim 10, wherein the second reinforcing member includes a third contact surface that comes into contact with at least one side wall of the second groove portion, a fourth contact surface that comes into contact with another side wall of the second groove portion, and a second joint plate that joins the third contact surface and the fourth contact surface, and is across the second groove portion, and the second projection is formed on the second joint plate.

15. The door frame structure according to claim 14, wherein the second projection to be formed on the second joint plate is formed on 30-70% of a surface of the second joint plate.

16. The door frame structure according to claim 11, wherein the first reinforcing member or the second reinforcing member has a notched portion that comes into contact with an outer surface of the recessed piece portion when the projecting piece portion is fitted in the recessed piece portion.

17. The door frame structure according to claim 10, wherein the first frame body includes a pair of first frame members and a second frame member, wherein the first frame members face each other and the second frame member couples to respective ends of the first frame members, and the second frame body includes a pair of third frame members and a fourth frame member, wherein the third frame members face each other and the fourth frame member couples to respective ends of the first frame members.

18. The door frame structure according to claim 17, wherein equal numbers of the reinforcing members are respectively disposed on the first frame members and the second frame member, and equal numbers of the reinforcing members are respectively disposed on the third frame members and the fourth frame member.

19. A method for mounting a door frame structure comprising the steps of:

installing a first reinforcing member at a predetermined position in a first groove portion recessed along outer peripheries of at least three sides of a first frame body being a frame;

fixing one surface of a mounting angle having at least two surfaces to the first reinforcing member and fixing another surface to an inner periphery of a wall in which a wall opening is formed;

installing a second reinforcing member at a predetermined position in a second groove portion recessed along outer peripheries of at least three sides of a second frame body being a frame; and coupling a second coupling portion of the second frame body to a first coupling portion of the first frame body such that the first frame body and the second frame body face each other, wherein the mounting angle is a unitary piece, the wall having the wall opening formed in which the first frame body and the second frame body are fitted, the first coupling portion is disposed adjacent to the first groove portion and the second coupling portion is disposed adjacent to the second groove portion, a first projection is formed on the first reinforcing member, and a second projection is formed on the second reinforcing member.

20. The method for mounting a door frame structure according to claim 19, wherein the step of installing the first reinforcing member includes a step of installing the first reinforcing member slidably in the first groove portion, and the step of installing the second reinforcing member includes a step of fixing the second reinforcing member to the second groove portion.

21. A method for mounting a door frame structure comprising the steps of:

installing a first reinforcing member at a predetermined position in a first groove portion recessed along an outer periphery of a first frame body being a jamb;

fixing one surface of a mounting angle having at least two surfaces to the first reinforcing member and fixing the other surface to an inner periphery of a wall in which a wall opening is formed;

installing a second reinforcing member at a predetermined position in a second groove portion recessed along an outer periphery of a second frame body being a jamb; and coupling a second coupling portion of the second frame body to a first coupling portion of the first frame body such that the first frame body and the second frame body face each other, wherein the mounting angle is a unitary piece, the wall having the wall opening formed in which the first frame body and the second frame body are fitted, the first coupling portion is disposed adjacent to the first groove portion and the second coupling portion is disposed adjacent to the second groove portion, a first projection is formed on the first reinforcing member, and a second projection is formed on the second reinforcing member.

22. The method for mounting a door frame structure according to claim 21, wherein the step of installing the first reinforcing member includes a step of installing the first reinforcing member slidably in the first groove portion, and the step of installing the second reinforcing member includes a step of fixing the second reinforcing member to the second groove portion.

* * * * *